US010672378B1

(12) United States Patent
Bastyr et al.

(10) Patent No.: US 10,672,378 B1
(45) Date of Patent: Jun. 2, 2020

(54) DYNAMIC IN-VEHICLE NOISE CANCELLATION DIVERGENCE CONTROL

(71) Applicant: Harman International Industries, Incorporated, Stamford, CT (US)

(72) Inventors: Kevin J. Bastyr, Franklin, MI (US); James May, Milford, MI (US); David Trumpy, Novi, MI (US)

(73) Assignee: HARMAN INTERNATIONAL INDUSTRIES, INCORPORATED, Stamford, CT (US)

( * ) Notice: Subject to any disclaimer, the term of this patent is extended or adjusted under 35 U.S.C. 154(b) by 0 days.

(21) Appl. No.: 16/405,109

(22) Filed: May 7, 2019

(51) Int. Cl.
*G10K 11/178* (2006.01)

(52) U.S. Cl.
CPC .. *G10K 11/17883* (2018.01); *G10K 11/17817* (2018.01); *G10K 11/17854* (2018.01)

(58) Field of Classification Search
CPC ..... G10K 11/17883; G10K 11/17817; G10K 11/17854
See application file for complete search history.

(56) References Cited

U.S. PATENT DOCUMENTS 5,910,993 A * 6/1999 Aoki ..... F16F 13/264 381/71.12
2019/0130890 A1* 5/2019 Tani ..... G10K 11/17825

* cited by examiner

*Primary Examiner* — Mark Fischer
(74) *Attorney, Agent, or Firm* — Brooks Kushman P.C.

(57) ABSTRACT

An active noise cancellation (ANC) system may include an adaptive filter divergence detector for detecting divergence of the one or more controllable filters as they adapt, based on dynamically adapted thresholds. Upon detection of a controllable filter divergence, the ANC system may be deactivated, or certain speakers may be muted. Alternatively, the ANC system may modify the diverged controllable filters to restore proper operation of the noise cancelling system.

20 Claims, 6 Drawing Sheets

| RPM | 2nd | 4th | 6th | 8th |
|---|---|---|---|---|
| 500 | 17 | 33 | 50 | 67 |
| 750 | 25 | 50 | 75 | 100 |
| 1000 | 33 | 67 | 100 | 133 |
| 1250 | 42 | 83 | 125 | 167 |
| 1500 | 50 | 100 | 150 | 200 |
| 1750 | 58 | 117 | 175 | 233 |
| 2000 | 67 | 133 | 200 | 267 |
| 2250 | 75 | 150 | 225 | 300 |
| 2500 | 83 | 167 | 250 | 333 |
| 2750 | 92 | 183 | 275 | 367 |
| 3000 | 100 | 200 | 300 | 400 |
| 3600 | 120 | 240 | 360 | 480 |
| 4000 | 133 | 267 | 400 | 533 |
| 5000 | 167 | 333 | 500 | 667 |
| 6000 | 200 | 400 | 600 | 800 |

400

DYNAMIC IN-VEHICLE NOISE CANCELLATION DIVERGENCE CONTROL

TECHNICAL FIELD

The present disclosure is directed to active noise cancellation and, more particularly, to mitigating the effects of adaptive filter divergence in engine order cancellation and/or road noise cancellation systems.

BACKGROUND

Active Noise Control (ANC) systems attenuate undesired noise using feedforward and feedback structures to adaptively remove undesired noise within a listening environment, such as within a vehicle cabin. ANC systems generally cancel or reduce unwanted noise by generating cancellation sound waves to destructively interfere with the unwanted audible noise. Destructive interference results when noise and "anti-noise," which is largely identical in magnitude but opposite in phase to the noise, combine to reduce the sound pressure level (SPL) at a location. In a vehicle cabin listening environment, potential sources of undesired noise come from the engine, the interaction between the vehicle's tires and a road surface on which the vehicle is traveling, and/or sound radiated by the vibration of other parts of the vehicle. Therefore, unwanted noise varies with the speed, road conditions, and operating states of the vehicle.

A Road Noise Cancellation (RNC) system is a specific ANC system implemented on a vehicle in order to minimize undesirable road noise inside the vehicle cabin. RNC systems use vibration sensors to sense road induced vibrations generated from the tire and road interface that leads to unwanted audible road noise. This unwanted road noise inside the cabin is then cancelled, or reduced in level, by using speakers to generate sound waves that are ideally opposite in phase and identical in magnitude to the noise to be reduced at the typical location of one or more listeners' ears. Cancelling such road noise results in a more pleasurable ride for vehicle passengers, and it enables vehicle manufacturers to use lightweight materials, thereby decreasing energy consumption and reducing emissions.

An Engine Order Cancellation (EOC) system is a specific ANC system implemented on a vehicle in order to minimize undesirable vehicle interior noise originating from the narrowband acoustic and vibrational emissions from the vehicle engine and exhaust system. EOC systems use a non-acoustic signal, such as a revolutions-per-minute (RPM) sensor, that generates a reference signal representative of the engine speed as a reference. This reference signal is used to generate sound waves that are opposite in phase to the engine noise audible in the vehicle interior. Because EOC systems use data from an RPM sensor, they do not require vibrations sensors.

RNC systems are typically designed to cancel broadband signals, while EOC systems are designed and optimized to cancel narrowband signals, such as individual engine orders. ANC systems within a vehicle may provide both RNC and EOC technology. Such vehicle-based ANC systems are typically Least Mean Square (LMS) adaptive feed-forward systems that continuously adapt W-filters based on both noise inputs (e.g., acceleration inputs from the vibration sensors in an RNC system) and signals of error microphones located in various positions inside the vehicle's cabin. ANC systems are susceptible to instability or divergence of the adaptive W-filters. As the W-filters are adapted by the LMS system, one or more of the W-filters may diverge, rather than converge to minimize the pressure at the location of an error microphone. Divergence of the adaptive filters may lead to broad or narrowband noise boosting or other undesirable behavior of the ANC system.

SUMMARY

In one or more illustrative embodiments, a method for controlling stability in an active noise cancellation (ANC) system is provided. The method may include receiving, from a vehicle sensor, sensor signals indicative of current vehicle operating conditions affecting an interior soundscape of a vehicle cabin and adjusting a nominal threshold for detecting ANC system divergence based on the sensor signals to obtain an adjusted threshold. The method may further include receiving an anti-noise signal output from a controllable filter, the anti-noise signal being indicative of anti-noise to be radiated from a speaker into the vehicle cabin. The method may further include computing a parameter based on an analysis of at least a portion of the anti-noise signal and modifying properties of the controllable filter in response to the parameter exceeding the adjusted threshold.

Implementations may include one or more of the following features. The parameter may be an amplitude of the anti-noise signal at one or more frequencies. The nominal threshold may be a predetermined static threshold programmed for the ANC system under nominal operating conditions. The sensor signals received from a vehicle sensor may include noise signals received from a vibration sensor. The sensor signals received from a vehicle sensor may include engine torque signals received from a vehicle network bus. The sensor signals received from a vehicle sensor may be indicative of at least one of vehicle speed, engine rotational speed, and accelerator pedal position. Adjusting the nominal threshold based on the sensor signals may include retrieving a threshold adjustment value from a look-up table based on a short-term average of the sensor signals and modifying the nominal threshold by the threshold adjustment value to obtain the adjusted threshold.

Modifying properties of the controllable filter may include deactivating at least one of the ANC system and the controllable filter. Modifying properties of the controllable filter may include resetting filter coefficients of the controllable filter to zero and allowing the controllable filter to re-adapt. Modifying properties of the controllable filter may include resetting filter coefficients of the controllable filter to a set of filter coefficient values stored in memory. Moreover, modifying properties of the controllable filter may include increasing a leakage value of the adaptive filter controller. To this end, the method may further include decreasing the leakage value of the adaptive filter controller when the parameter falls below the adjusted threshold.

One or more additional embodiments may be directed to an ANC system including at least one controllable filter configured to generate an anti-noise signal based on an adaptive transfer characteristic and a noise signal received from a sensor. The adaptive transfer characteristic of the at least one controllable filter may be characterized by a set of filter coefficients. The ANC system may further include an adaptive filter controller and a divergence controller in communication with at least the adaptive filter controller. The adaptive filter controller may include a processor and memory programmed to adapt the set of filter coefficients based on the noise signal and an error signal received from a microphone located in a cabin of a vehicle. The divergence controller may include a processor and memory programmed to: receive, from a vehicle sensor, sensor signals indicative of current vehicle operating conditions affecting an interior soundscape of the cabin; adjust a dynamic threshold for detecting ANC system divergence based on the sensor signals; receive the error signal from the microphone and compute a parameter based on an analysis of at least a portion of the error signal; and modify properties of the at least one controllable filter in response to the parameter exceeding the dynamic threshold.

Implementations may include one or more of the following features. The parameter may be an amplitude of the error signal at one or more frequencies. The sensor signals received from a vehicle sensor may include at least one of the noise signal and an engine torque signal. The properties of the at least one controllable filter may be modified by the divergence controller by resetting the filter coefficients of the at least one controllable filter to a known state using a different set of filter coefficients stored in memory. Alternatively, the properties of the at least one controllable filter may be modified by the divergence controller by increasing a leakage value of the adaptive filter controller.

One or more additional embodiments may be directed to a computer-program product embodied in a non-transitory computer readable medium that is programmed for active noise cancellation (ANC). The computer-program product may include instructions for: receiving, from a vehicle sensor, sensor signals indicative of current vehicle operating conditions affecting an interior soundscape of a vehicle cabin; adjusting a nominal threshold for detecting ANC system divergence based on the sensor signals to obtain an adjusted threshold; and receiving at least one of an anti-noise signal output from a controllable filter and an error signal output from a microphone located in the vehicle cabin, the anti-noise signal being indicative of anti-noise to be radiated from a speaker into the vehicle cabin. The computer-program product may include further instructions for: computing a parameter based on an analysis of at least one of the anti-noise signal and the error signal; and modifying an adaptive transfer characteristic of the controllable filter in response to the parameter exceeding the adjusted threshold.

Implementations may include one or more of the following features. The computer-program product where the instructions for modifying an adaptive transfer characteristic of the controllable filter may include: detecting diverged frequencies of the controllable filter; and resetting the diverged frequencies of the controllable filter to zero, attenuating filter coefficients at the diverged frequencies, or increasing a leakage value of an adaptive filter controller at the diverged frequencies. Moreover, the instructions for modifying an adaptive transfer characteristic of the controllable filter may include decreasing a rate of change of the adaptive transfer characteristic.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Any one or more of the controllers or devices described herein include computer executable instructions that may be compiled or interpreted from computer programs created using a variety of programming languages and/or technologies. In general, a processor (such as a microprocessor) receives instructions, for example from a memory, a computer-readable medium, or the like, and executes the instructions. A processing unit includes a non-transitory computer-readable storage medium capable of executing instructions of a software program. The computer readable storage medium may be, but is not limited to, an electronic storage device, a magnetic storage device, an optical storage device, an electromagnetic storage device, a semi-conductor storage device, or any suitable combination thereof.

Figure 1:
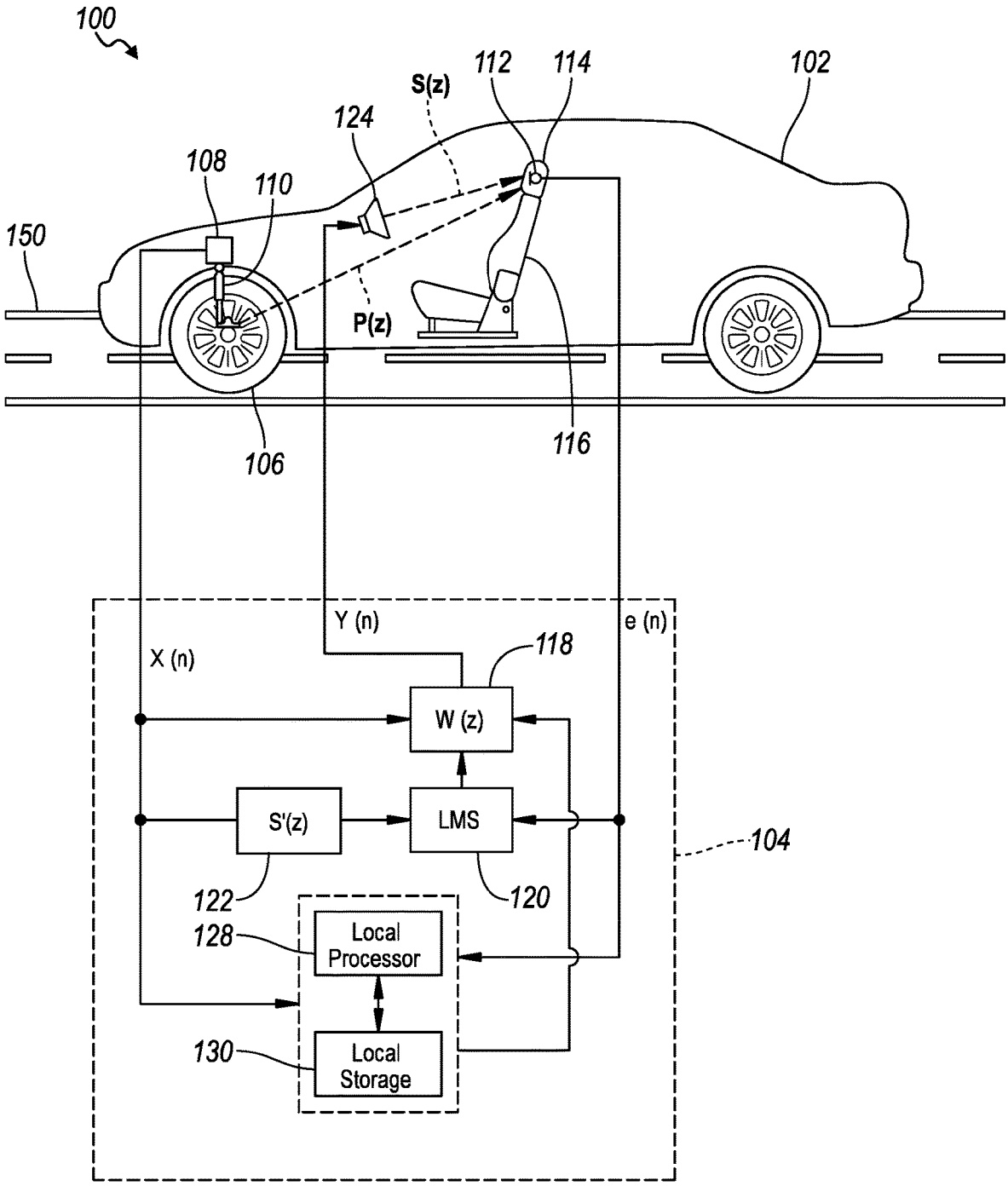
FIG. 1 is an environmental block diagram of a vehicle having an active noise control (ANC) system including a road noise cancellation (RNC), in accordance with one or more embodiments of the present disclosure.

FIG. 1 shows a road noise cancellation (RNC) system 100 for a vehicle 102 having one or more vibration sensors 108. The vibration sensors are disposed throughout the vehicle 102 to monitor the vibratory behavior of the vehicle's suspension, subframe, as well as other axle and chassis components. The RNC system 100 may be integrated with a broadband feed-forward and feedback active noise control (ANC) framework or system 104 that generates anti-noise by adaptive filtering of the signals from the vibration sensors 108 using one or more microphones 112. The anti-noise signal may then be played through one or more speakers 124. S(z) represents a transfer function between a single speaker 124 and a single microphone 112. While FIG. 1 shows a single vibration sensor 108, microphone 112, and speaker 124 for simplicity purposes only, it should be noted that typical RNC systems use multiple vibration sensors 108 (e.g., 10 or more), microphones 112 (e.g., 4 to 6), and speakers 124 (e.g., 4 to 8).

The vibration sensors 108 may include, but are not limited to, accelerometers, force gauges, geophones, linear variable differential transformers, strain gauges, and load cells.

Accelerometers, for example, are devices whose output signal amplitude is proportional to acceleration. A wide variety of accelerometers are available for use in RNC systems. These include accelerometers that are sensitive to vibration in one, two and three typically orthogonal directions. These multi-axis accelerometers typically have a separate electrical output (or channel) for vibrations sensed in their X-direction, Y-direction and Z-direction. Single-axis and multi-axis accelerometers, therefore, may be used as vibration sensors 108 to detect the magnitude and phase of acceleration and may also be used to sense orientation, motion, and vibration.

Noise and vibrations that originate from a wheel 106 moving on a road surface 150 may be sensed by one or more of the vibration sensors 108 mechanically coupled to a suspension device 110 or a chassis component of the vehicle 102. The vibration sensor 108 may output a noise signal X(n), which is a vibration signal that represents the detected road-induced vibration. It should be noted that multiple vibration sensors are possible, and their signals may be used separately, or may be combined in various ways known by those of skilled in the art. In certain embodiments, a microphone, acoustic energy sensor, acoustic intensity sensor, or acoustic velocity sensor may be used in place of a vibration sensor to output the noise signal X(n) indicative of noise generated from the interaction of the wheel 106 and the road surface 150. The noise signal X(n) may be filtered with a modeled transfer characteristic S'(z), which estimates the secondary path (i.e., the transfer function between an anti-noise speaker 124 and an error microphone 112), by a secondary path filter 122.

Road noise that originates from interaction of the wheel 106 and the road surface 150 is also transferred, mechanically and/or acoustically, into the passenger cabin and is received by the one or more microphones 112 inside the vehicle 102. The one or more microphones 112 may, for example, be located in a headrest 114 of a seat 116 as shown in FIG. 1. Alternatively, the one or more microphones 112 may be located in a headliner of the vehicle 102, or in some other suitable location to sense the acoustic noise field heard by occupants inside the vehicle 102. The road noise originating from the interaction of the road surface 150 and the wheel 106 is transferred to the microphone 112 according to a transfer characteristic P(z), which represents the primary path (i.e., the transfer function between an actual noise source and an error microphone).

The microphones 112 may output an error signal e(n) representing the noise present in the cabin of the vehicle 102 as detected by the microphones 112. In the RNC system 100, an adaptive transfer characteristic W(z) of a controllable filter 118 may be controlled by adaptive filter controller 120, which may operate according to a known least mean square (LMS) algorithm based on the error signal e(n) and the noise signal X(n) filtered with the modeled transfer characteristic S'(z) by the filter 122. The controllable filter 118 is often referred to as a W-filter. The LMS adaptive filter controller 120 may provide a summed cross-spectrum configured to update the transfer characteristic W(z) filter coefficients based on the error signals e(n). The process of adapting or updating W(z) that results in improved noise cancellation is referred to as converging. Convergence refers to the creation of W-filters that minimize the error signals e(n), which is controlled by a step size governing the rate of adaption for the given input signals. The step size is a scaling factor that dictates how fast the algorithm will converge to minimize e(n) by limiting the magnitude change of the W-filter coefficients based on each update of the controllable W-filter 118.

An anti-noise signal Y(n) may be generated by an adaptive filter formed by the controllable filter 118 and the adaptive filter controller 120 based on the identified transfer characteristic W(z) and the noise signal, or a combination of noise signals, X(n). The anti-noise signal Y(n) ideally has a waveform such that when played through the speaker 124, anti-noise is generated near the occupants' ears and the microphone 112 that is substantially opposite in phase and identical in magnitude to that of the road noise audible to the occupants of the vehicle cabin. The anti-noise from the speaker 124 may combine with road noise in the vehicle cabin near the microphone 112 resulting in a reduction of road noise-induced sound pressure levels (SPL) at this location. In certain embodiments, the RNC system 100 may receive sensor signals from other acoustic sensors in the passenger cabin, such as an acoustic energy sensor, an acoustic intensity sensor, or an acoustic particle velocity or acceleration sensor to generate error signal e(n).

While the vehicle 102 is under operation, a processor 128 may collect and optionally processes the data from the vibration sensors 108 and the microphones 112 to construct a database or map containing data and/or parameters to be used by the vehicle 102. The data collected may be stored locally at a storage 130, or in the cloud, for future use by the vehicle 102. Examples of the types of data related to the RNC system 100 that may be useful to store locally at storage 130 include, but are not limited to, accelerometer or microphone spectra or time dependent signals, other acceleration characteristics including spectral and time dependent properties, pre-adapted W-filter values, expected error signal and anti-noise signal thresholds for low-, mid- and high-torque situations, typical error signal and anti-noise signal thresholds at various speeds on various pavement types (e.g., smooth, rough, chip-seal, cobblestones, expansion-joint, etc.), dynamic leakage increment and decrement values, and the like. In addition, the processor 128 may analyze the sensor data and extract key features to determine a set of key parameters to be applied to the RNC system 100. The set of key parameters may be selected when a parameter exceeds a threshold. In one or more embodiments, the processor 128 and storage 130 may be integrated with one or more RNC system controllers, such as the adaptive filter controller 120.

As previously described, typical RNC systems may use several vibration sensors, microphones and speakers to sense structure-borne vibratory behavior of a vehicle and generate anti-noise. The vibrations sensor may be multi-axis accelerometers having multiple output channels. For instance, triaxial accelerometers typically have a separate electrical output for vibrations sensed in their X-direction, Y-direction, and Z-direction. A typical configuration for an RNC system may have, for example, 6 error microphones, 6 speakers, and 12 channels of acceleration signals coming from 4 triaxial accelerometers or 6 dual-axis accelerometers. Therefore, the RNC system will also include multiple S'(z) filters (i.e., secondary path filters 122) and multiple W(z) filters (i.e., controllable filters 118).

The simplified RNC system schematic depicted in FIG. 1 shows one secondary path, represented by S(z), between each speaker 124 and each microphone 112. As previously mentioned, RNC systems typically have multiple speakers, microphones and vibration sensors. Accordingly, a 6-speaker, 6-microphone RNC system will have 36 total secondary paths (i.e., 6×6). Correspondingly, the 6-speaker, 6-microphone RNC system may likewise have 36 S'(z) filters (i.e., stored secondary path filters 122), which estimate the transfer function for each secondary path. As shown in FIG. 1, an RNC system will also have one W(z) filter (i.e., controllable filter 118) between each noise signal X(n) from a vibration sensor (i.e., accelerometer) 108 and each speaker 124. Accordingly, a 12-accelerometer signal, 6-speaker RNC system may have 72 W(z) filters. The relationship between the number of accelerometer signals, speakers, and W(z) filters is illustrated in FIG. 2.

Figure 2:
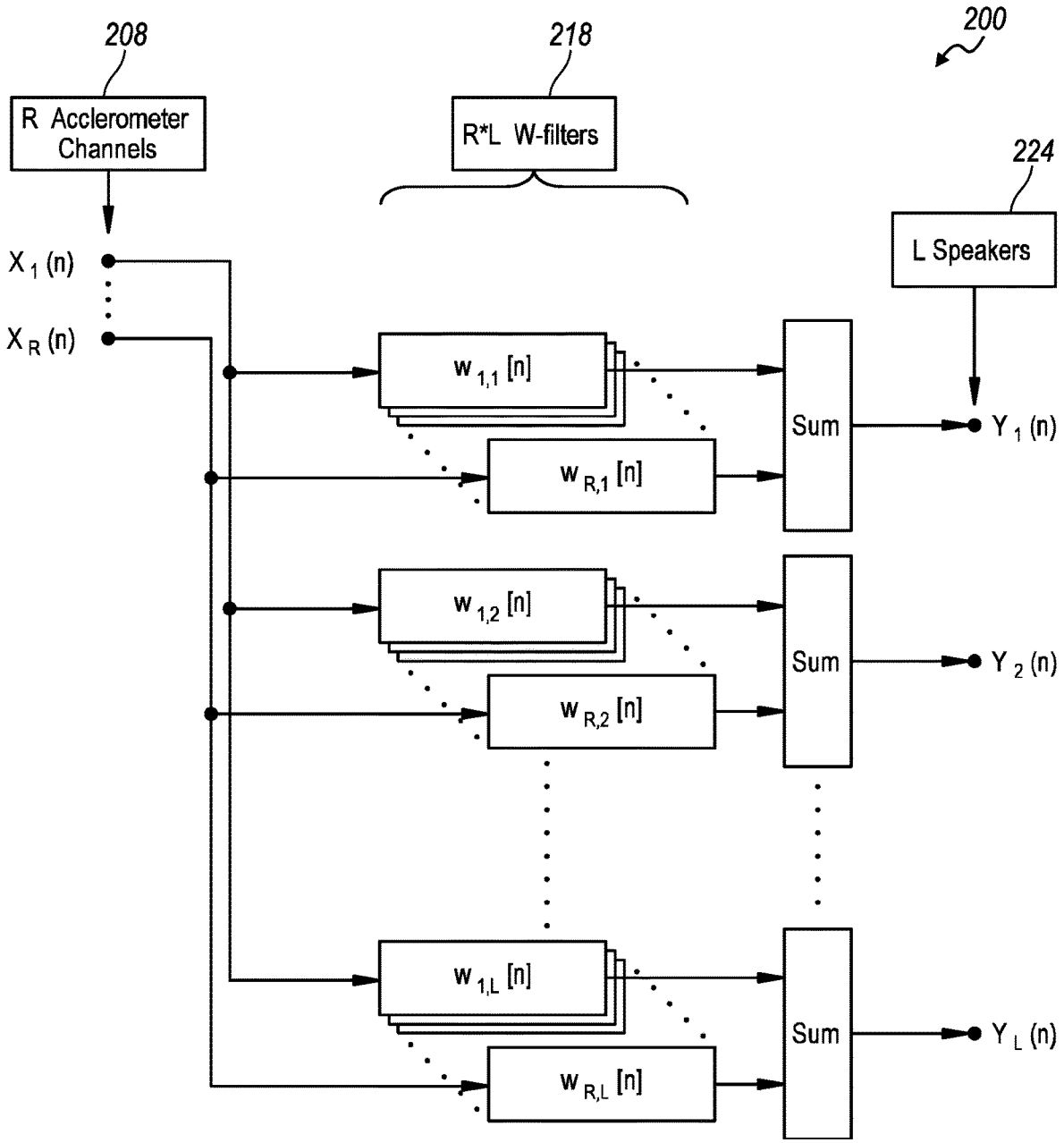
FIG. 2 is a sample schematic diagram demonstrating relevant portions of an RNC system scaled to include R accelerometer signals and L speaker signals.

FIG. 2 is a sample schematic diagram demonstrating relevant portions of an RNC system 200 scaled to include R accelerometer signals $[X_1(n), X_2(n), \ldots X_R(n)]$ from accelerometers 208 and L anti-noise signals $[Y_1(n), Y_2(n), \ldots Y_L(n)]$ from speakers 224. Accordingly, the RNC system 200 may include R*L controllable filters (or W-filters) 218 between each of the accelerometer signals and each of the speakers. As an example, an RNC system having 12 accelerometer outputs (i.e., R=12) may employ 6 dual-axis accelerometers or 4 triaxial accelerometers. In the same example, a vehicle having 6 speakers (i.e., L=6) for reproducing anti-noise, therefore, may use 72 W-filters in total. At each of the L speakers, R W-filter outputs are summed to produce the speaker's anti-noise signal Y(n). Each of the L speakers may include an amplifier (not shown). In one or more embodiments, the R accelerometer signals filtered by the R W-filters are summed to create an electrical anti-noise signal y(n), which is fed to the amplifier to generate an amplified anti-noise signal Y(n) that is sent to a speaker.

The ANC system 104 illustrated in FIG. 1 may also include an engine order cancellation (EOC) system. As mentioned above, EOC technology uses a non-acoustic signal such as an RPM signal representative of the engine speed as a reference in order to generate sound that is opposite in phase to the engine noise audible in the vehicle interior. Common EOC systems utilize a narrowband feed-forward ANC framework to generate anti-noise using an RPM signal to guide the generation of an engine order signal identical in frequency to the engine order to be cancelled, and adaptively filtering it to create an anti-noise signal. After being transmitted via a secondary path from an anti-noise source to a listening position or error microphone, the anti-noise ideally has the same amplitude, but opposite phase, as the combined sound generated by the engine and exhaust pipes and filtered by the primary paths that extend from the engine to the listening position and from the exhaust pipe outlet to the listening position. Thus, at the place where an error microphone resides in the vehicle cabin (i.e., most likely at or close to the listening position), the superposition of engine order noise and anti-noise would ideally become zero so that acoustic error signal received by the error microphone would only record sound other than the (ideally cancelled) engine order or orders generated by the engine and exhaust.

Commonly, a non-acoustic sensor, for example an RPM sensor, is used as a reference. RPM sensors may be, for example, Hall Effect sensors which are placed adjacent to a spinning steel disk. Other detection principles can be employed, such as optical sensors or inductive sensors. The signal from the RPM sensor can be used as a guiding signal for generating an arbitrary number of reference engine order signals corresponding to each of the engine orders. The reference engine orders form the basis for noise cancelling signals generated by the one or more narrowband adaptive feed-forward LMS blocks that form the EOC system.

Figures 3, 4:
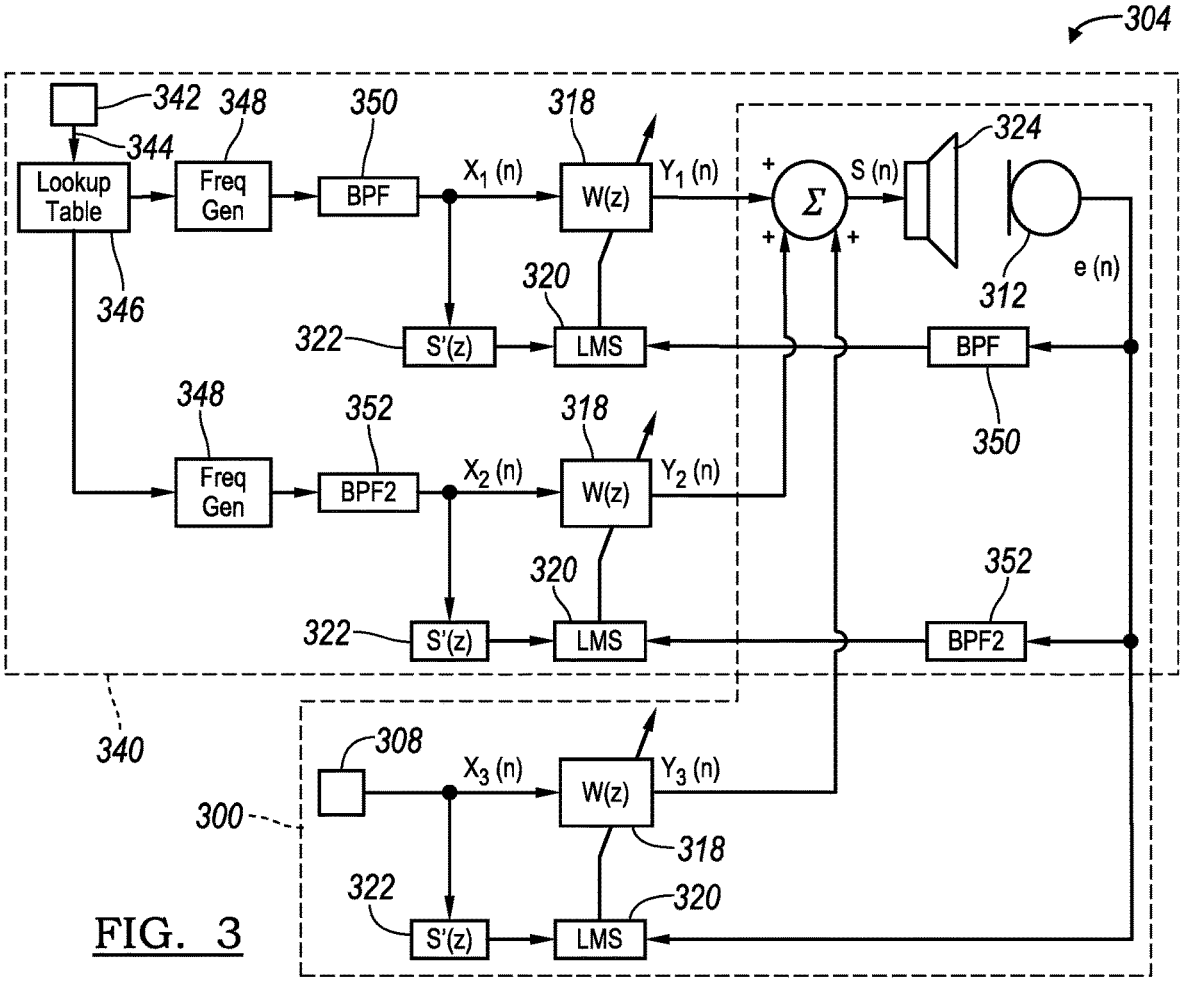
FIG. 3 is a sample schematic block diagram of an ANC system including an engine order cancellation (EOC) system and an RNC system.
FIG. 4 is a sample lookup table of frequencies of each engine order for a given RPM in an EOC system.

FIG. 3 is a schematic block diagram illustrating an example of an ANC system 304, including both an RNC system 300 and an EOC system 340. Similar to RNC system 100, the RNC system 300 may include elements 308, 312, 318, 320, 322, and 324, consistent with operation of elements 108, 112, 118, 120, 122, and 124, respectively, discussed above. The EOC system 340 may include an RPM sensor 342, which may provide an RPM signal 344 (e.g., a square-wave signal) indicative of rotation of an engine drive shaft or other rotating shaft indicative of the engine rotational speed. In some embodiments, the RPM signal 344 may be obtained from a vehicle network bus (not shown). As the radiated engine orders are directly proportional to the drive shaft RPM, the RPM signal 344 is representative of the frequencies produced by the engine and exhaust system. Thus, the signal from the RPM sensor 342 may be used to generate reference engine order signals corresponding to each of the engine orders for the vehicle. Accordingly, the RPM signal 344 may be used in conjunction with a lookup table 346 of RPM vs. Engine Order Frequency, which provides a list of engine orders radiated at each RPM.

FIG. 4 illustrates an example EOC cancellation tuning table 400, which may be used to generate lookup table 346. The example table 400 lists frequencies (in cycles per second) of each engine order for a given RPM. In the illustrated example, four engine orders are shown. The LMS algorithm takes as an input the RPM and generates a sine wave for each order based on this lookup table 400. As previously described, the relevant RPM for the table 400 may be drive shaft RPM.

Referring back to FIG. 3, the frequency of a given engine order at the sensed RPM, as retrieved from the lookup table 346, may be supplied to a frequency generator 348, thereby generating a sine wave at the given frequency. This sine wave represents a noise signal X(n) indicative of engine order noise for a given engine order. Similar to the RNC system 300, this noise signal X(n) from the frequency generator 348 may be sent to an adaptive controllable filter 318, or W-filter, which provides a corresponding anti-noise signal Y(n) to the loudspeaker 324. As shown, various components of this narrowband, EOC system 340 may be identical to the broadband RNC system 300, including the error microphone 312, adaptive filter controller 320 and secondary path filter 322. The anti-noise signal Y(n), broadcast by the speaker 324 generates anti-noise that is substantially out of phase but identical in magnitude to the actual engine order noise at the location of a listener's ear, which may be in close proximity to an error microphone 312, thereby reducing the sound amplitude of the engine order. Because engine order noise is narrowband, the error microphone signal e(n) may be filtered by a bandpass filter 350, 352 prior to passing into the LMS-based adaptive filter controller 320. In an embodiment, proper operation of the LMS adaptive filter controller 320 is achieved when the noise signal X(n) output by the frequency generator 348 is bandpass filtered using the same bandpass filter parameters.

In order to simultaneously reduce the amplitude of multiple engine orders, the EOC system 340 may include multiple frequency generators 348 for generating a noise signal X(n) for each engine order based on the RPM signal 344. As an example, FIG. 3 shows a two order EOC system having two such frequency generators for generating a unique noise signal (e.g., $X_1(n)$, $X_2(n)$, etc.) for each engine order based on engine speed. Because the frequency of the two engine orders differ, the bandpass filters 350, 352 (labeled BPF and BPF2, respectively) have different high- and low-pass filter corner frequencies. The number of frequency generators and corresponding noise-cancellation components will ultimately vary based on the number of engine orders for a particular engine of the vehicle. As the two-order EOC system 340 is combined with the RNC system 300 to form ANC system 304, the anti-noise signals Y(n) output from the three controllable filters 318 are summed and sent to the speaker 324 as a speaker signal S(n). Similarly, the error signal e(n) from the error microphone 312 may be sent to the three LMS adaptive filter controllers 320.

One leading factor that can lead to instability or reduced noise cancellation performance in ANC systems occurs when the adaptive W-filters diverge during adaptation by the feed-forward LMS system. When the adaptive W-filters properly converge, sound pressure levels at the location of error microphones are minimized. However, when one or more of these adaptive W-filters diverge, instability resulting in noise boosting may occur instead of noise cancellation. Accordingly, a system and method may be employed to detect and control the divergence of adaptive filters to maintain ANC system performance and stability.

ANC systems may detect instability or noise boosting caused by W-filter mis-adaptation or divergence by acquiring and analyzing data from one or more microphones disposed about the cabin of passenger vehicles. The interior soundscape of a vehicle can greatly vary, however. For instance, interior soundscape of a vehicle cabin may range from very quiet to very loud as the vehicle accelerates from a low speed, low engine torque scenario to a high vehicle speed, high engine torque scenario. Current ANC systems only allow a single in-cabin SPL threshold to detect all instabilities. This approach can be problematic because the interior noise level in a vehicle depends on vehicle speed, engine output torque, road surface roughness, and the like. Thus, at high vehicle speed and high engine torque, for example, the microphone SPL threshold should be set relatively high, as there is a high amount of engine noise when the system is operating properly. However, with a low vehicle speed and a low engine torque, there is a relatively low amount of engine noise when the system is operating properly, necessitating a low SPL threshold to quickly detect instability.

Because current systems only allow only a single SPL threshold, it is typically set to a very high level to permit proper ANC operation at high vehicle speed (i.e., so the ANC algorithm doesn't just deactivate at high vehicle speed or on rough roads). Therefore, at low and medium vehicle speed with a relatively low torque, the W-filter mis-adaptation that results in noise boosting may not be detected quickly, or at all. Rather, instability during this low speed/low torque operating condition may take a relatively long time to detect, i.e., until the noise boosting grows high enough in amplitude to exceed the high SPL threshold. Meanwhile, the vehicle occupants are subjected to an instability that grows to a high, annoying amplitude over a relatively long duration of time (e.g., 20 seconds or more). Consequently, relying on a single in-cabin SPL magnitude limit to use as a threshold detector for ANC instability may be inadequate. To avoid late (or possibly no) detection of EOC/RNC noise boosting, instability or divergence, a dynamically determined SPL threshold may be employed.

Briefly, in-cabin SPL values, as measured by microphones, may be compared to dynamically determined SPL thresholds. For EOC, the SPL threshold may, for example, be multiplied by a factor proportional to engine torque. For instance, when the vehicle is in a high torque driving scenario, a relatively high SPL threshold may be generated by multiplying a nominal SPL threshold by a (high) torque multiplier. When the vehicle is in a low torque driving scenario, a low SPL threshold may be generated by multiplying the nominal SPL threshold by a (low) torque multiplier. A short time average of an engine torque signal, or other vehicle signals that may serve as an adequate proxy for engine torque, may be required for better performance of this algorithm. For RNC, the same dynamic thresholding may be employed for early detection of instability. In the case of RNC, a short time average of a noise signal output from a vibration sensor, such as an accelerometer, can replace the engine torque value. This is because the interior noise levels are relatively high on rough roads, which have high amplitude accelerometer output, and relatively low for smooth roads, which have low amplitude accelerometer output. If SPL values exceed these dynamic thresholds, divergence mitigation may be employed to prevent noise boosting or other undesirable behavior, such as inadequate noise cancellation. Divergence mitigation may include, for example, muting the ANC system, resetting the diverged W-filters to a zero state or some other stored state, a temporary or permanent increase in W-filter leakage, and the like.

According to one or more additional embodiments, ANC instability detection may be employed using dynamic thresholding of anti-noise signals Y(n) instead of in-cabin SPL as determined by microphone error signals e(n). The microphone error signals e(n) may include all the noise sources in the passenger cabin. Rather than detecting only engine noise or road noise, error microphones also detect wind noise, music, speech, and any other interfering noises in the passenger cabin, which are contained in corresponding error signals e(n). Moreover, an error signal e(n) in a purely RNC system also includes engine noise, and an error signal e(n) in a purely EOC system also includes road noise. The anti-noise signal Y(n) generated by the ANC system does not contain any of the aforementioned interfering signals, and the anti-noise signal Y(n) contribution from an EOC system can be analyzed separately from the anti-noise signal Y(n) contribution from the RNC system when these systems are combined into one ANC system.

In an embodiment, an EOC instability detection threshold applied to the anti-noise signal Y(n) may be dynamically modified by a value stored in a lookup table of a short time average of the engine torque signal. This is because the level of anti-noise generated by the LMS-based EOC algorithm is relatively high for high engine torque and relatively low for low engine torque. While engine torque may be used as a guiding signal for approximating engine noise in order to determine the dynamic instability threshold, other guiding signals like engine speed, accelerator pedal position, vehicle acceleration, instantaneous gas mileage, or even statistics from the fuel pump, may be similarly employed.

Similarly, an RNC instability detection threshold applied to the anti-noise signal Y(n) may be dynamically modified by a value stored in a lookup table of a short time average of a noise signal X(n), such as is output from a vibration sensor. This is because the level of anti-noise generated by the RNC algorithm is relatively high for rough roads and relatively low for smooth roads. Other signals indicative of a rough pavement type may be used instead of those from a vibration sensor. For example, a GPS-derived or previously stored roughness estimate of a road currently being traversed may be used as a guiding signal for the lookup table instead of a processed output from an accelerometer or other vibration sensor.

Figure 5:
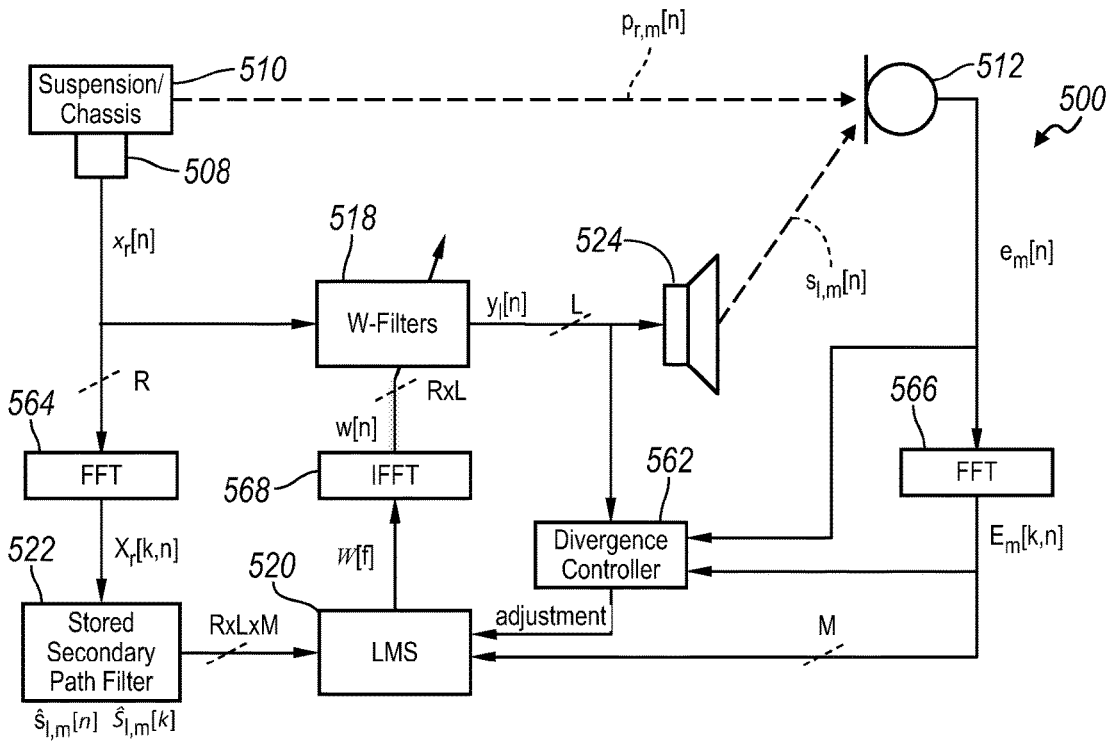
FIG. 5 is a schematic block diagram representing an ANC system including a divergence controller, in accordance with one or more embodiments of the present disclosure.

FIG. 5 is a schematic block diagram of a vehicle-based ANC system 500 showing many of the key ANC system parameters that may be used to detect divergence of the adaptive W-filters and optimize ANC system performance. For ease of explanation, the ANC system 500 illustrated in FIG. 5 is shown with components and features of an RNC system, such as RNC system 100. However, the ANC system 500 may include an EOC system such as shown and described in connection with FIG. 3. Accordingly, the ANC system 500 is a schematic representation of an RNC and/or EOC system, such as those described in connection with FIGS. 1-3, featuring additional system components. Similar components may be numbered using a similar convention. For instance, similar to RNC system 100, the ANC system 500 may include elements 508, 510, 512, 518, 520, 522, and 524, consistent with operation of elements 108, 110, 112, 118, 120, 122, and 124, respectively, discussed above.

As shown, the ANC system 500 may further include a divergence controller 562 disposed along the path between the controllable filter 518 and the adaptive filter controller 520. The divergence controller 562 may include a processor and memory (not shown) programmed to detect divergence of the controllable filters 518. This may include computing parameters by analyzing samples from the error signal from microphone 512 and/or the anti-noise signal from the controllable filter 518 in either or both the time domain or the frequency domain. To this end, FIG. 5 explicitly illustrates Fast Fourier transform (FFT) blocks 564, 566 and inverse Fast Fourier transform (IFFT) block 568 for transforming signals between the time and frequency domain. Accordingly, variable names in FIG. 5 are slightly altered from those shown in FIGS. 1-3. Upper-case variables represent signals in the frequency domain, while lower-case variables represent signals in the time domain. The letter "n" denotes a sample in the time domain, while the letter "k" denotes a bin in the frequency domain. The diagram in FIG. 5 further illustrates the presence of multiple signals, showing R reference signals, L speaker signals and M error signals. The table below provides a detailed explanation of the various symbols and variables in FIG. 5.

| Symbol | Definition |
|---|---|
| [n] | Sample in the time domain |
| [k] | Bin in the frequency domain |
| R | Total dimensional number of reference noise signals |
| L | Total dimensional number of anti-noise signals |
| M | Total dimensional number of error signals |
| r | Individual reference noise signal, r = 1 . . . R |
| 1 | Individual anti-noise signal, l = 1 . . . L |
| m | Individual error signal, m = 1 . . . M |
| $x_r$ [n] | Reference noise signals in the time domain |
| $X_r$ [k, n] | Time-dependent reference noise signals in the frequency domain |
| $\hat{S}_{l,m}$ [k] | Estimated secondary paths in the frequency domain, L × M matrix |
| $\hat{s}_{l,m}$ [n] | Estimated secondary paths in the time domain, L × M matrix |
| $s_{l,m}$ [n] | Secondary path in the time domain, L × M matrix |
| $p_{r,m}$ [k, n] | Time-dependent primary propagation paths in the frequency domain, R × M matrix |
| $y_l$ [n] | Anti-noise signals in the time domain |
| $e_m$ [n] | Error signals in the time domain |
| $E_m$ [k, n] | Time-dependent error signals in the frequency domain |

Similar to FIG. 1, the noise signal $x_r[n]$ from the noise input, such as vibration sensor 508, may be transformed and filtered with a modeled transfer characteristic $\hat{S}_{l,m}[k]$, using stored estimates of the secondary path as previously described, by a secondary path filter 522. Moreover, an adaptive transfer characteristic $w_{r,l}[n]$ of a controllable filter 518 (e.g., a W-filter) may be controlled by LMS adaptive filter controller (or simply LMS controller) 520 to provide an adaptive filter. The noise signal, as filtered by the secondary path filter 522, and an error signal $e_m[n]$ from the microphone 512 are inputs to the LMS adaptive filter controller 520. The anti-noise signal $y_l[n]$ may be generated by the controllable filter 518 adapted by the LMS controller 520, and the noise signal $x_r[n]$.

The divergence controller 562 may receive the time domain error signal $e_m[n]$ and/or frequency domain error signal $E_m[k, n]$ from the microphone(s) 512. Additionally or alternatively, the divergence controller 562 may receive the anti-noise signal(s) $y_l[n]$ generated by the controllable filter (s) 518. Moreover, the divergence controller 562 may compute one or more parameters by analyzing the error signal or anti-noise signal. The parameter may be an amplitude of the error signal and/or anti-noise signal at one or more frequencies or frequency ranges, though other parameters may be employed. In an embodiment, the parameter is a frequency-dependent amplitude of the error signal and/or anti-noise signal in one or more frequency ranges. The parameter may be compared to a dynamic threshold for detecting instability of the ANC system (e.g., divergence of the controllable filter 518). If divergence is detected, the divergence controller 562 may send an adjustment signal back to the adaptive filter controller 520 instructing the adaptive filter controller to modify properties of the at least one controllable filter 518, or adaptation parameter of the LMS system 520, such as leakage.

In either RNC or EOC systems, the response to detecting divergence may be for the divergence controller 562 to substitute for some or all of the W-filter values using, for example, adjusted W-filters that have been previously stored. Other responses to the detection of divergence by the divergence controller 562 may include replacing some or all of the controllable filters 518 with a filter consisting of zeros, which effectively resets the controllable filter. Other divergence mitigation measures by the divergence controller 562 may include adding leakage at frequencies including the diverged frequencies, resetting the coefficients at the diverged frequencies to or toward zero, attenuating some or all of the W-filter coefficients, or reducing the step size (i.e., decreasing a rate of change of the adapter transfer characteristic of the controllable filter 518) to lower the risk of future divergence events. In certain embodiments, the adjustment signal from the divergence controller 562 may mute the ANC algorithm for a period of time (referred to as a "pause") before unmuting with or without any of the above-described modifications to the controllable W-filters 518.

The divergence controller 562 may be a dedicated controller for detecting diverged controllable W-filters or may be integrated with another controller or processor in the ANC system, such as the LMS controller 520. Alternatively, the divergence controller 562 may be integrated into another controller or processor within vehicle 102 that is separate from the other components in the ANC system 500.

Figure 6:
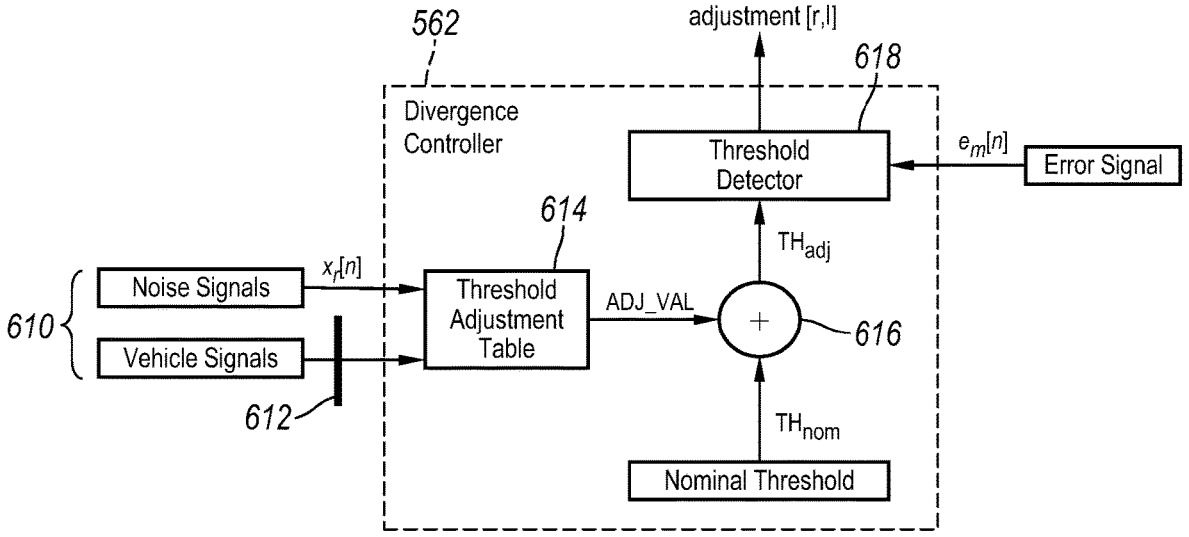
FIG. 6 is a block diagram depicting the divergence controller from FIG. 5 in greater detail, in accordance with one or more embodiments of the present disclosure.

FIG. 6 is a block diagram showing the divergence controller 562 in more detail, according to one or more embodiments of the present disclosure. As previously described, the threshold for detecting instability of the ANC system 500 may be dynamic to account for the varying interior soundscape of the vehicle cabin. Accordingly, the divergence controller 562 may be further configured to modify or adjust this dynamic instability threshold. In the example shown in FIG. 6, instability of the ANC system 500 may be detected by evaluating in-cabin SPL against a dynamic instability threshold using an error signal $e_m[n]$ from the microphone 512. However, it should be noted that the divergence controller 562 may similarly detect instability using the anti-noise signal $y_l[n]$, as previously described.

The divergence controller 562 may store or receive a nominal threshold $TH_{nom}$ against which the error signal $e_m[n]$ may be compared under predetermined nominal vehicle operating conditions. The divergence controller 562 may also receive, from one or more vehicle sensors, sensor signals 610 indicative of current vehicle operating conditions that may affect the interior soundscape of a vehicle cabin. As previously described, the sensor signals 610 may include the noise signal $x_r[n]$ from the noise input, such as vibration sensor 508, which may generally indicate the interior noise level due to current road conditions. The sensor signals 610 may also include other vehicle signals generally indicative of engine noise, such as engine torque, engine rotational speed, vehicle speed, accelerator pedal position, and the like. The sensor signals 610 may also include signals indicative of any music or other audio playing out of speakers and any associated characteristics of the audio, such as its frequency dependent amplitude. Moreover, the vehicle signals may be received by the divergence controller 562 from a vehicle network bus 612, such as a controller area network (CAN) bus.

The divergence controller 562 may further include a threshold adjustment table 614. The threshold adjustment table 614 may be a lookup table that stores threshold adjustment values used to dynamically modify the nominal SPL threshold $TH_{nom}$ based on one or more of the sensor signals 610. That is, one or more of the sensor signals 610 may be used to obtain an adjustment value ADJ_VAL from threshold adjustment table 614. In an embodiment, a short-term average of one or more of the sensor signals 610 may be used to obtain an adjustment value ADJ_VAL from threshold adjustment table 614. The adjustment value may be combined with the nominal threshold to obtain an adjusted threshold $TH_{adj}$. As shown, the threshold adjustment value may modify the nominal threshold through an adding operation as denoted by adder 616. Alternatively, the nominal threshold may be multiplied by threshold adjustment value to obtain the adjusted threshold. For instance, as previously described, the threshold adjustment value may be a factor proportional to a value indicated by the sensors signals 610 (e.g., engine torque, accelerometer output, etc.).

The divergence controller may further include a threshold detector 618. The threshold detector 618 may receive both the adjusted threshold and the error signal (or anti-noise signal). The threshold detector 618 may further compare the error signal (or anti-noise signal) to the adjusted threshold. In certain embodiments, the threshold detector 618 may compute a parameter based on an analysis of at least a portion of the error signal (or anti-noise signal). Instability, noise boosting or divergence of the ANC system 500 may be detected by the threshold detector 618 if the error signal or corresponding parameter exceeds the adjusted threshold. If instability is detected, the threshold detector 618 may generate an adjustment signal, which is communicated by the divergence controller 562 back to the adaptive filter controller 520, as previously described. Essentially, the adjustment signal may include instructions for modifying properties of the controllable filter 518 or LMS adaptive filter controller 520 in response to the error signal, or corresponding parameter, exceeding the adjusted threshold. In certain embodiments, the adjustment signal may simply be a positive indicator to the adaptive filter controller 520 that divergence has been detected. In other embodiments, the adjustment signal may include specific instructions regarding the response strategy that should be employed by the adaptive filter controller 520.

Figure 7:
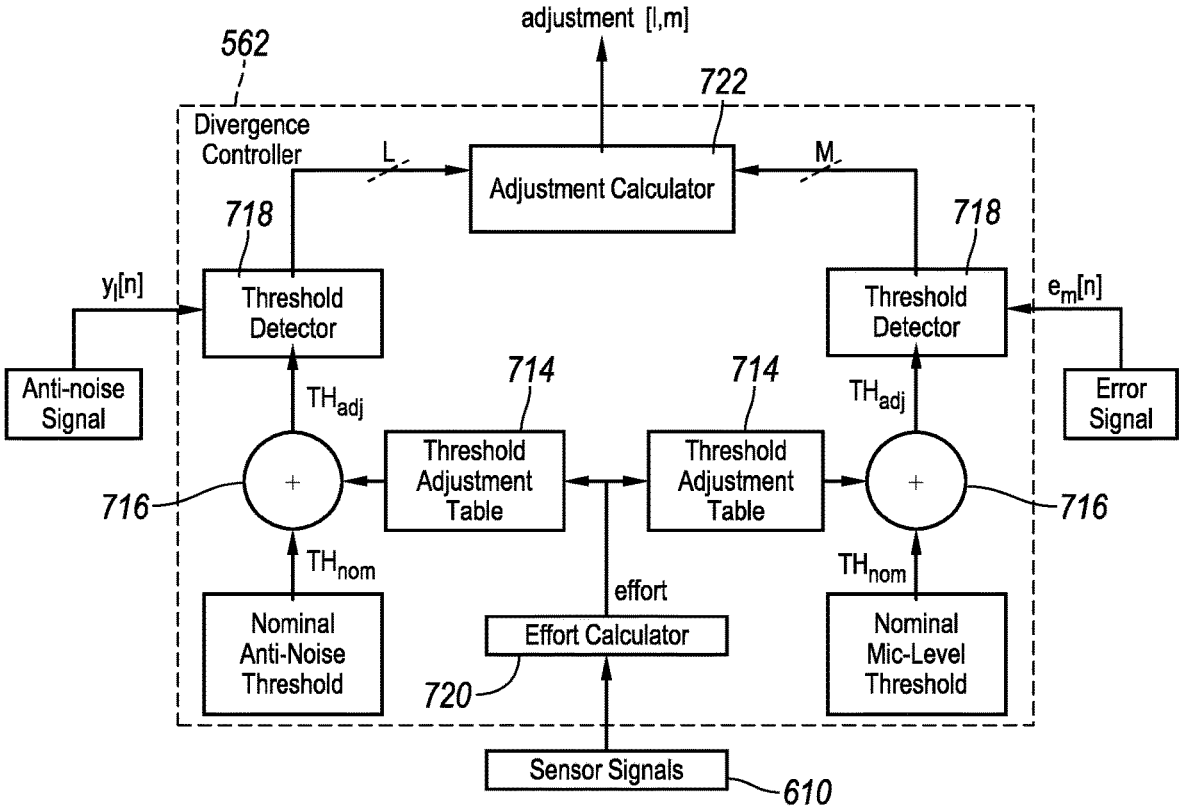
FIG. 7 is an alternate block diagram depicting the divergence controller from FIG. 5 in greater detail, in accordance with one or more embodiments of the present disclosure.
Figure 8:
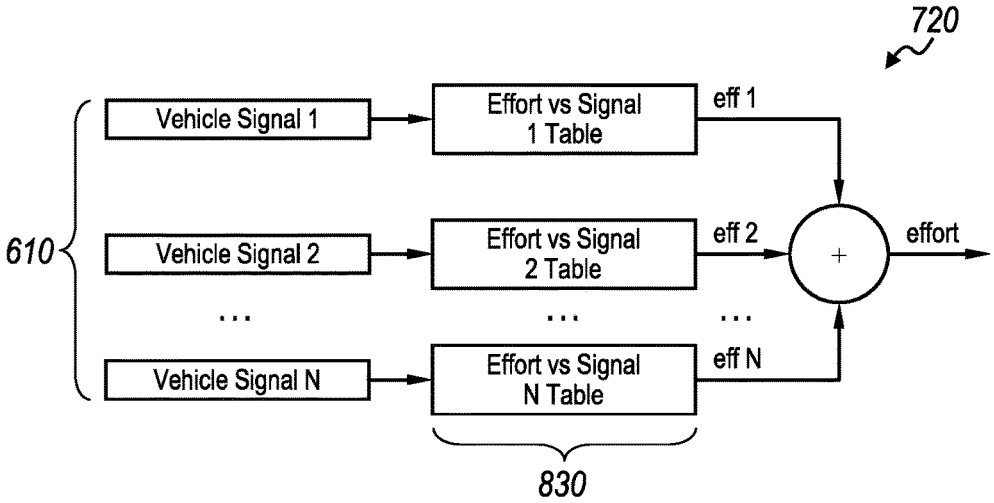
FIG. 8 is a block diagram depicting an effort calculator for the divergence controller, in accordance with one or more embodiments of the present disclosure.

FIG. 7 is a block diagram an alternative embodiment for the divergence controller 562. In this embodiment, the divergence controller 562 may analyze both the error signal and the anti-noise signal for divergence along separate paths and calculate a joint adjustment value based on results of the divergence analysis of both incoming signals. In this embodiment, the divergence controller 562 may store or receive a nominal threshold $TH_{nom}$ for both the anti-noise signal and the error signal. For example, the error signal $e_m[n]$ may be compared against a nominal mic-level threshold under predetermined nominal vehicle operating conditions. Likewise, the anti-noise signal $y_l[n]$ may be compared against a nominal anti-noise threshold under predetermined nominal vehicle operating conditions. As previously described, the divergence controller 562 may also receive, from one or more vehicle sensors, the sensor signals 610 indicative of current vehicle operating conditions that may affect the interior soundscape of a vehicle cabin. As shown in FIG. 7, the sensor signals 610 may be received by an effort calculator 720. The effort calculator 720 may consider multiple sensor signals in computing an overall effort value (effort) that is indicative of current vehicle operating conditions affecting the interior soundscape of a vehicle cabin. FIG. 8 is an exemplary block diagram illustrating the effort calculator 720 in greater detail. As shown, the effort calculator 720 may include multiple effort vs sensor signal lookup tables 830. Each of the sensor signals 610 used to indicate the current interior soundscape (e.g., engine torque, pedal position, accelerometer output, etc.) may feed into associated lookup table 830 to obtain a corresponding effort value component (i.e., eff1, eff2 . . . effN). The effort value components may be combined to generate the overall effort value output by the effort calculator 720.

Referring back to FIG. 7, the divergence controller 562 may further include a pair of threshold adjustment tables 714, one each for the anti-noise signal and the error signal. The threshold adjustment tables 714 may be lookup tables that store threshold adjustment values used to dynamically modify the nominal thresholds $TH_{nom}$ based on the effort value. A separate threshold adjustment table 714 may be provided for both the nominal anti-noise threshold and the nominal mic-level threshold because the corresponding adjustment values may differ for a given effort value. The adjustment value may be combined with the nominal threshold to obtain an adjusted threshold $TH_{adj}$. Similar to FIG. 6, each threshold adjustment value may modify the respective nominal threshold through mathematical operators 716 to obtain a pair of adjusted thresholds, one each for the anti-noise signal and the error signal. Each adjusted threshold may be received by a corresponding threshold detector 718. A first threshold detector 718 may receive both an adjusted anti-noise threshold and the anti-noise signal (or anti-noise signal), while a second threshold detector 718 may receive both an adjusted mic-level threshold and the error signal. The threshold detectors 718 may further compare the or anti-noise signal to the adjusted anti-noise threshold and the error signal to the adjusted mic-level threshold, respectively. In certain embodiments, the threshold detectors 718 may compute a parameter based on an analysis of at least a portion of the anti-noise signal and error signal, respectively.

Instability or divergence of the ANC system 500 may be detected by either or both of the threshold detectors 718 if the input signals or corresponding parameter exceed their respective adjusted thresholds. The output of each threshold detector 718 may be received by an adjustment calculator 722. The adjustment calculator 722 may generate a joint adjustment output as the adjustment value communicated to the adaptive filter controller 520 as previously described. Because there is one anti-noise signal $y_l[n]$ for each of the L speakers 524, and there is one error signal $e_m[n]$ from each of the M microphones 512, it is possible for the adjustment calculator 722 to mitigate the noise boosting without acting on all of the R×L W-filters. In an embodiment, if a threshold of one anti-noise signal is exceeded indicating noise boosting, then only the R W-filters that are combined into this one anti-noise signal can be acted on. This is the least invasive change to the system that can mitigate boosting.

It is possible to still act on more than these R W-filters in effort to mitigate noise boosting. In another embodiment, if one error signal $e_m[n]$ exceeds its dynamically adjusted threshold thereby indicating noise boosting, only the W-filters of the most proximate speakers might be acted on in effort to mitigate boosting. In yet another embodiment, if one error signal $e_m[n]$ exceeds its dynamically adjusted threshold thereby indicating noise boosting, only the W-filters of the speaker or speakers with this highest magnitude transfer function S(z) to this microphone might be acted on in effort to mitigate boosting. Optionally, only the W-filters contributing to the speaker signal or signals having the highest magnitude transfer function S(z) in this frequency range of the noise boosting may be acted on. Alternatively, all the speakers might be acted on. Because there are L anti-noise signals, when one of the L anti-noise signals $y_l[n]$ exceeds its adjusted threshold, mitigation can be triggered on one or multiple of the W-filters contributing to the anti-noise signal.

Figure 9:
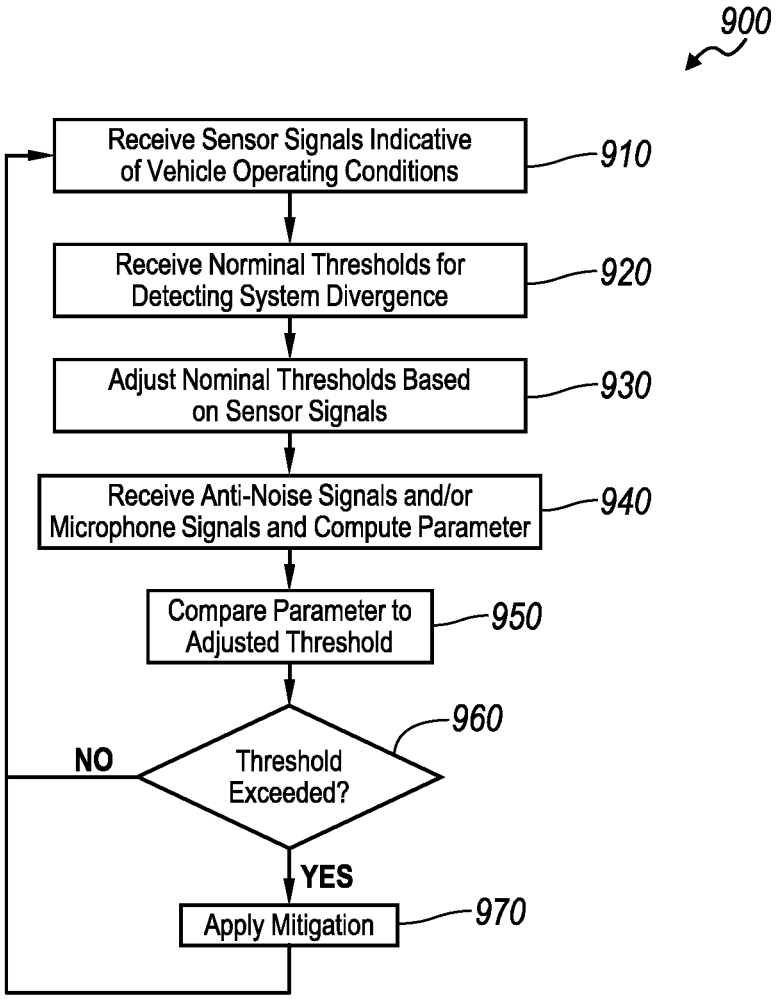
FIG. 9 is a flowchart depicting a method for detecting and correcting divergence of adaptive filters in an ANC system, in accordance with one or more embodiments of the present disclosure.

FIG. 9 is a flowchart depicting a method 900 for mitigating the effects of diverged or mis-adapted controllable W-filters in the ANC system 500. Various steps of the disclosed method may be carried out by the divergence controller 562, either alone, or in conjunction with other components of the ANC system.

At step 910, the divergence controller 562 may receive one or more sensor signals indicative of current vehicle operating conditions affecting the interior soundscape of a vehicle cabin. For example, the sensor signals may include a noise signal $x_r[n]$ from a noise input, such as the vibration sensor 508. Additionally, the sensor signals may include other vehicle signals indicative of other vehicle operating parameters, such as engine torque, engine rotational speed, vehicle speed, accelerator pedal position, and the like. Such additional sensor data may be received from, for example, the vehicle's Controller Area Network (CAN) bus. At step 920, the divergence controller 562 may further receive a nominal threshold for detecting ANC system divergence or noise boosting. For instance, if the divergence controller 562 is evaluating ANC system stability based on an analysis of the error signal $e_m[n]$, the nominal threshold may be a nominal mic-level threshold corresponding to in-cabin SPL limits under predetermined nominal operating conditions. Alternatively, if the divergence controller 562 is evaluating ANC system stability based on an analysis of the anti-noise signal $y_l[n]$, the nominal threshold may be a nominal anti-noise threshold corresponding to anti-noise SPL limits under predetermined nominal operating conditions. These nominal thresholds may be frequency dependent over one or more small or large bands of frequencies.

At step 930, the divergence controller 562 may adjust the nominal threshold for detecting ANC system divergence based on the sensor signals to obtain an adjusted threshold. According to one or more embodiments, adjusting the nominal threshold may include retrieving a threshold adjustment value from a look-up table based on a short-term average of the sensor signals and modifying the nominal threshold by the threshold adjustment value to obtain the adjusted threshold. Modifying the nominal threshold by the threshold adjustment value may include adding the adjustment threshold value to the nominal threshold or multiplying the nominal threshold by the threshold adjustment value.

At step 940, the divergence controller 562 may receive an input signal for detecting ANC system instability and compute an analysis based on at least a portion of the input signal. As previously described, the input signal for detecting system instability may include the error signal $e_m[n]$ or the anti-noise signal $y_l[n]$. The parameter computed from the input signal may be an amplitude of the input signal at one or more frequencies.

At step 950, the parameter computed from the input signal, either the error signal or anti-noise signal, may be compared directly to the corresponding adjusted threshold. If the parameter exceeds the adjusted threshold, the divergence controller 562 may conclude that divergence or mis-adaptation has been detected. If the parameter from the input signal does not exceed the threshold, the divergence controller 562 may conclude that no divergence or mis-adaptation has been detected.

Referring to step 960, when the adjusted threshold has been exceeded indicating divergence of the controllable filter, the method may proceed to step 970. At step 970, mitigating measures may be applied to the diverged controllable W-filter to minimize the in-cabin noise boosting or reduced ANC effects of W-filter divergence. However, when no divergence is detected, the method may skip any mitigation and return to step 910 so the process can repeat.

At step 970, the divergence mitigation may be applied to any of either or both the time domain or frequency domain W-filters that have diverged or mis-adapted. In certain embodiments, the counter measures may be applied to an entire W-filter or only to specific frequencies for a frequency domain W-filter. The mitigation methods that can be applied to the entire controllable W-filter (in either the time or frequency domain) may include re-setting the filter coefficients of one or more W-filters to zero to allow it to re-adapt or setting the filter coefficients to a set of filter coefficient values stored in a memory of the ANC system. The set of filter coefficient values stored in memory may include those from a W-filter in a known good state, such as a W-filter that has been tuned by trained engineers or were obtained from the controllable filter prior to when divergence was detected. For instance, the controllable filter may be re-set using filter coefficients it had, for example, 10 seconds or 1 minute prior to divergence. Alternatively, the controllable W-filter may be reset to an initial condition, such as when the ANC system 500 was powered on. Another mitigation technique may be to simply deactivate or mute the ANC system when divergence has been detected. In an embodiment, only the W-filters that have diverged can be deactivated or set to zero and not allowed to adapt when divergence has been detected. In an embodiment, the amplitude of all the filter taps or magnitude of all the frequency domain filter coefficients can be reduced when divergence has been detected. In an embodiment, the value of leakage at all frequencies can be increased by the adaptive filter controller 520 in response to an adjustment signal from the divergence controller 562 when divergence has been detected.

Counter measures which apply only to the frequency-domain approach may include attenuating the W-filter coefficients at or near the diverged frequencies and adding or increasing the value of leakage at or near the diverged frequencies. In an embodiment for mitigation applied in the frequency domain, the divergence controller 562 can adaptively notch out unstable, diverged frequencies identified in step 630, by adding notch or band reject filters on input signals $x_r[n]$ and $e_m[n]$ or their frequency domain counterparts. This will prevent the adaptive filter controller 520 from increasing the magnitude of the W-filters in this problematic frequency range in future operation of the ANC system 500. This can optionally be accompanied by a resetting of the W-filters outlined above, or the use of leakage at these unstable, diverged frequencies or all frequencies.

As previously mentioned, in one or more additional embodiments, the value of leakage can be increased at the LMS adaptive filter controller 520 when divergence has been detected, such as when the anti-noise signal $y_l[n]$ exceeds its adjusted threshold. This leakage value can be continuously increased by a predetermined amount with each iteration through the process flow shown in FIG. 9 as long as the anti-noise signal $y_l[n]$ still exceeds its adjusted threshold. Once the anti-noise signal $y_l[n]$ no longer exceeds its adjusted threshold, the value of leakage can be decreased by a predetermined amount during subsequent iterations through the process flow shown in FIG. 9 as long as the anti-noise signal $y_l[n]$ no longer exceeds its adjusted threshold.

In an embodiment, leakage may be increased for all W-filters in ANC system 500 when the anti-noise signal $y_l[n]$ exceeds its adjusted threshold. In another embodiment, the leakage is increased on all the W-filters for a particular speaker when the anti-noise signal $y_l[n]$ for that speaker exceeds its adjusted threshold. The LMS controller 520 may be instructed to increase or decrease the leakage value in response to receiving the adjustment signal from the divergence controller 562. In an embodiment, an analogous process of ramping up the leakage can result if an error signal $e_m[n]$ exceeds its adjusted threshold, followed by ramping down the leakage if it continues to not exceed its adjusted threshold.

As previously described, there exists one controllable W-filter for each combination of speaker 512 and noise input (e.g., each engine order or vibration sensor). Accordingly, a 12-accelerometer, 6-speaker RNC system will have 72 W-filters (i.e., 12×6=72) and a 5-engine order, 6-speaker EOC system will have 30 W-filters (i.e., 5×6=30). The method 9000 illustrated in FIG. 9 can be performed after every new set of W-filters is calculated, or less frequently, in order to reduce the computational power required, thereby saving CPU cycles.

Note that multiplying or dividing the sensor output voltage by the adjustment value can have the same effect as dividing or multiplying the threshold by the adjustment value. That is, in alternate embodiments, the signals $y_l[n]$ and or $e_m[n]$ can be adjusted, rather than adjusting the detection thresholds. A flow slightly modified from FIG. 9 results, though the detection thresholding still functions.

Although FIGS. 1, 3, and 5 show LMS-based adaptive filter controllers 120, 320, and 520, respectively, other methods and devices to adapt or create optimal controllable W-filters 118, 318, and 518 are possible. For example, in one or more embodiments, neural networks may be employed to create and optimize W-filters in place of the LMS adaptive filter controllers. In other embodiments, machine learning or artificial intelligence may be used to create optimal W-filters in place of the LMS adaptive filter controllers.

In the foregoing specification, the inventive subject matter has been described with reference to specific exemplary embodiments. Various modifications and changes may be made, however, without departing from the scope of the inventive subject matter as set forth in the claims. The specification and figures are illustrative, rather than restrictive, and modifications are intended to be included within the scope of the inventive subject matter. Accordingly, the scope of the inventive subject matter should be determined by the claims and their legal equivalents rather than by merely the examples described.

For example, the steps recited in any method or process claims may be executed in any order and are not limited to the specific order presented in the claims. Equations may be implemented with a filter to minimize effects of signal noises. Additionally, the components and/or elements recited in any apparatus claims may be assembled or otherwise operationally configured in a variety of permutations and are accordingly not limited to the specific configuration recited in the claims.

Those of ordinary skill in the art understand that functionally equivalent processing steps can be undertaken in either the time or frequency domain. Accordingly, though not explicitly stated for each signal processing block in the figures, particularly FIGS. 1-3, the signal processing may occur in either the time domain, the frequency domain, or a combination thereof. Moreover, though various processing steps are explained in the typical terms of digital signal processing, equivalent steps may be performed using analog signal processing without departing from the scope of the present disclosure Benefits, advantages and solutions to problems have been described above with regard to particular embodiments. However, any benefit, advantage, solution to problems or any element that may cause any particular benefit, advantage or solution to occur or to become more pronounced are not to be construed as critical, required or essential features or components of any or all the claims.

The terms "comprise", "comprises", "comprising", "having", "including", "includes" or any variation thereof, are intended to reference a non-exclusive inclusion, such that a process, method, article, composition or apparatus that comprises a list of elements does not include only those elements recited, but may also include other elements not expressly listed or inherent to such process, method, article, composition or apparatus. Other combinations and/or modifications of the above-described structures, arrangements, applications, proportions, elements, materials or components used in the practice of the inventive subject matter, in addition to those not specifically recited, may be varied or otherwise particularly adapted to specific environments, manufacturing specifications, design parameters or other operating requirements without departing from the general principles of the same.

What is claimed is:

1. A method for controlling stability in an active noise cancellation (ANC) system, the method comprising:

receiving, from a vehicle sensor, sensor signals indicative of current vehicle operating conditions affecting an interior soundscape of a vehicle cabin;

adjusting a nominal threshold for detecting ANC system divergence based on the sensor signals to obtain an adjusted threshold;

receiving an anti-noise signal output from a controllable filter, the anti-noise signal being indicative of anti-noise to be radiated from a speaker into the vehicle cabin;

computing a parameter based on an analysis of at least a portion of the anti-noise signal; and modifying properties of the controllable filter in response to the parameter exceeding the adjusted threshold.

2. The method of claim 1, wherein the parameter is an amplitude of the anti-noise signal at one or more frequencies.

3. The method of claim 1, wherein the nominal threshold is a predetermined static threshold programmed for the ANC system under nominal operating conditions.

4. The method of claim 1, wherein the sensor signals received from a vehicle sensor includes noise signals received from a vibration sensor.

5. The method of claim 1, wherein the sensor signals received from a vehicle sensor include engine torque signals.

6. The method of claim 1, wherein the sensor signals received from a vehicle sensor are indicative of at least one of vehicle speed, engine rotational speed, and accelerator pedal position.

7. The method of claim 1, wherein adjusting the nominal threshold based on the sensor signals comprises:

retrieving a threshold adjustment value from a look-up table based on a short-term average of the sensor signals; and modifying the nominal threshold by the threshold adjustment value to obtain the adjusted threshold.

8. The method of claim 1, wherein modifying properties of the controllable filter comprises deactivating at least one of the ANC system and the controllable filter.

9. The method of claim 1, wherein modifying properties of the controllable filter comprises resetting filter coefficients of the controllable filter to zero and allowing the controllable filter to re-adapt.

10. The method of claim 1, wherein modifying properties of the controllable filter comprises resetting filter coefficients of the controllable filter to a set of filter coefficient values stored in memory.

11. The method of claim 1, wherein modifying properties of the controllable filter comprises increasing a leakage value of the adaptive filter controller.

12. The method of claim 11, further comprising:

decreasing the leakage value of the adaptive filter controller when the parameter falls below the adjusted threshold.

13. An active noise cancellation (ANC) system comprising:

at least one controllable filter configured to generate an anti-noise signal based on an adaptive transfer characteristic and a noise signal received from a sensor, the adaptive transfer characteristic of the at least one controllable filter characterized by a set of filter coefficients;

an adaptive filter controller, including a processor and memory, programmed to adapt the set of filter coefficients based on the noise signal and an error signal received from a microphone located in a cabin of a vehicle; and a divergence controller in communication with at least the adaptive filter controller, the divergence controller including a processor and memory programmed to:

receive, from a vehicle sensor, sensor signals indicative of current vehicle operating conditions affecting an interior soundscape of the cabin;

adjust a dynamic threshold for detecting ANC system divergence based on the sensor signals;

receive the error signal from the microphone and compute a parameter based on an analysis of at least a portion of the error signal; and modify properties of the at least one controllable filter in response to the parameter exceeding the dynamic threshold.

14. The ANC system of claim 13, wherein the parameter is an amplitude of the error signal at one or more frequencies.

15. The ANC system of claim 13, wherein the sensor signals received from a vehicle sensor includes at least one of the noise signal and an engine torque signal.

16. The ANC system of claim 13, wherein the properties of the at least one controllable filter is modified by the divergence controller by resetting the filter coefficients of the at least one controllable filter to a known state using a different set of filter coefficients stored in memory.

17. The ANC system of claim 13, wherein the properties of the at least one controllable filter is modified by the divergence controller by increasing a leakage value of the adaptive filter controller.

18. A computer-program product embodied in a non-transitory computer readable medium that is programmed for active noise cancellation (ANC), the computer-program product comprising instructions for:

receiving, from a vehicle sensor, sensor signals indicative of current vehicle operating conditions affecting an interior soundscape of a vehicle cabin;

adjusting a nominal threshold for detecting ANC system divergence based on the sensor signals to obtain an adjusted threshold;

receiving at least one of an anti-noise signal output from a controllable filter and an error signal output from a microphone located in the vehicle cabin, the anti-noise signal being indicative of anti-noise to be radiated from a speaker into the vehicle cabin;

computing a parameter based on an analysis of at least one of the anti-noise signal and the error signal; and modifying an adaptive transfer characteristic of the controllable filter in response to the parameter exceeding the adjusted threshold.

19. The computer-program product of claim 18, wherein the instructions for modifying an adaptive transfer characteristic of the controllable filter includes:

detecting diverged frequencies of the controllable filter; and resetting the diverged frequencies of the controllable filter to zero, attenuating filter coefficients at the diverged frequencies, or increasing a leakage value of an adaptive filter controller at the diverged frequencies.

20. The computer-program product of claim 18, wherein the instructions for modifying an adaptive transfer characteristic of the controllable filter includes decreasing a rate of change of the adaptive transfer characteristic.

* * * * *